United States Patent [19]

Morimitsu et al.

[11] 4,143,262

[45] Mar. 6, 1979

[54] SHEATH GLOW PLUG FOR ROTARY PISTON ENGINES

[75] Inventors: Nobutaka Morimitsu, Toyota; Tomio Kumoi, Kariya; Katsuhiko Tsuruta, Toyota, all of Japan

[73] Assignee: Toyota Jidosha Kogyo Kabushiki Kaisha, Toyota, Japan

[21] Appl. No.: 810,891

[22] Filed: Jun. 27, 1977

[30] Foreign Application Priority Data

Mar. 3, 1977 [JP] Japan ..... 52-23191

[51] Int. Cl.[2] ..... F23Q 7/00; F02P 19/02; H05B 3/48

[52] U.S. Cl. ..... 219/270; 123/145 A; 219/534; 219/544; 338/218; 338/240; 338/316; 338/333; 361/264

[58] Field of Search ..... 219/260–270, 219/544, 534, 205–208, 316, 318, 335, 336, 523, 538; 361/264; 123/145 R, 145 A; 338/229, 238–243, 217, 218, 263–266, 267, 268, 271, 326, 333, 316

[56] References Cited

U.S. PATENT DOCUMENTS

| | | | |
|---|---|---|---|
| 1,230,619 | 6/1917 | Strickler et al. | 219/316 X |
| 1,237,851 | 8/1917 | Wygodsky | 123/145 A |
| 1,474,723 | 11/1923 | Levinson | 338/240 |
| 2,130,365 | 9/1938 | Paulson | 123/145 A |
| 2,506,768 | 5/1950 | Bentz et al. | 219/260 X |
| 2,533,615 | 12/1950 | Osterheld | 2109/523 X |
| 2,643,317 | 6/1953 | Tuttle | 338/241 X |
| 2,884,920 | 5/1959 | Moule et al. | 219/270 UX |
| 3,158,787 | 11/1964 | Testerini | 219/260 |

FOREIGN PATENT DOCUMENTS

| | | | |
|---|---|---|---|
| 515699 | 11/1920 | France | 219/523 |
| 568519 | 11/1957 | Italy | 123/145 A |
| 1110333 | 4/1968 | United Kingdom | 219/260 |

*Primary Examiner*—A. Bartis

*Attorney, Agent, or Firm*—Stevens, Davis, Miller & Mosher

[57] ABSTRACT

A glow plug for rotary piston engines adapted to be mounted in an engine plug hole so as not to project from the plug hole and to be traversed by a flow of fuel-air mixture temporarily trapped in the plug hole. The plug includes an elongated protective tube providing a straight root portion by which it is supported from a plug housing adapted to be inserted in a plug hole. The tube terminates in a closed end hook-shaped free tip portion spaced from the root portion and plug housing and lying in the same plane as the root portion. A helical heater coil is disposed in the protective tube with the pitch of the coil being smaller at the free tip portion than at the root portion so that greater heat is generated in the free tip portion than in the root portion.

2 Claims, 4 Drawing Figures

SHEATH GLOW PLUG FOR ROTARY PISTON ENGINES

BACKGROUND OF THE INVENTION

The present invention relates to a glow plug for use with automobile engines and, more particularly, an improvement of a sheath glow plug for adapting it for use with the Wankel type rotary piston engine.

Conventionally, glow plugs are mostly used in diesel engines, particularly those of a type having an auxiliary combustion chamber for the purpose of facilitating engine start-up. In this case, the glow plug is mounted to project into the space of the auxiliary combustion chamber so as to preheat air existing in the auxiliary combustion chamber. As a heating element of the glow plug a durable sheath heater is generally employed which comprises a protective tube and a heater coil mounted in the protective tube. The conventional sheath heater elements employed for diesel engines are mostly of the straight type wherein the protective tube is a straight tube.

In recent developments of Wankel type rotary piston engines, it has been contemplated to employ the glow plug for rotary piston engines instead of the conventional spark plug for the purpose of improving ignition of fuel and thereby improving exhaust gas purification and load performance of the engine. Since the heater element of the glow plug is continuously red-hot due to a continuous supply of electric current, it provides a sustaining ignition source for all combustion chambers of the rotary piston engine over a substantial period in which they traverse the combustion stroke, whereby the occurrence of misfiring is substantially avoided even in idling operation or in low-load low speed operation of the engine.

However, in a rotary piston engine, the glow plug, like a usual spark plug, cannot be mounted to project into the combustion chamber, and it must be mounted in a relatively small plug hole generally formed in the trochoidal peripheral wall of the rotor housing. Therefore, it is only the tip portion of the heater element that is effectively exposed to a flow of fuel-air mixture generated in the combustion chamber during the operation of the engine so as to contribute to igniting the fuel-air mixture. Therefore, when the conventional glow plug having a uniformly heat generating heater element is employed in a rotary piston engine, the tip portion of the heater element is subject to a high rate of cooling by the traversing gas flow when compared with the root portion of the heater element. In this case, there occurs a problem that if a large electric current is supplied in order to maintain the tip portion at a sufficiently high temperature required for effecting good ignition, the root portion of the heater element is overheated and is liable to fuse breaking. Further, if a conventional glow plug such as used in diesel engines and having a straight heater element is employed for a rotary piston engine, there is a problem that only a very small effective heating surface area is available at the tip portion of the heater element.

SUMMARY OF THE INVENTION

It is therefore the object of the present invention to solve the abovementioned problems encountered in employing glow plugs in rotary piston engines and to provide an improved glow plug for use with rotary piston engines.

In accordance with the present invention, the abovementioned object is accomplished by providing a sheath glow plug for rotary piston engines comprising a plug housing, a protective tube supported by said housing at its root portion and having a curved tip portion and a heater coil mounted in said protective tube, wherein the pitch of said heater coil is smaller at said curved tip portion than at said root portion.

In the sheath glow plug of abovementioned structure, a larger effective heating surface area is made available by the curved tip portion of the protective tube when compared with the conventional straight heater element and a higher rate of heat generation is effected at the curved tip portion of the protective tube when compared with that at its root portion due to the higher density of heater coil wire at the tip portion effected by a smaller pitch at the tip portion. By judiciously varying the pitch of the heater coil along the protective tube, the variation of the rate of heat generation at various portions of the protective tube is adapted to compensate for the variation of cooling rate effected by the flow of fuel-air mixture at the different portions so that the tip portion of the protective tube is maintained at a desireable high temperature while the root portion of the protective tube is maintained at any desireable moderate temperature.

BRIEF DESCRIPTION OF THE DRAWING

The present invention will be described in more detail hereinunder with respect to a preferred embodiment thereof with reference to the accompanying drawings which are given for the purpose of illustration only and are therefore not limitative of the invention, and wherein.

DESCRIPTION OF THE PREFERRED EMBODIMENT

Figure 1:
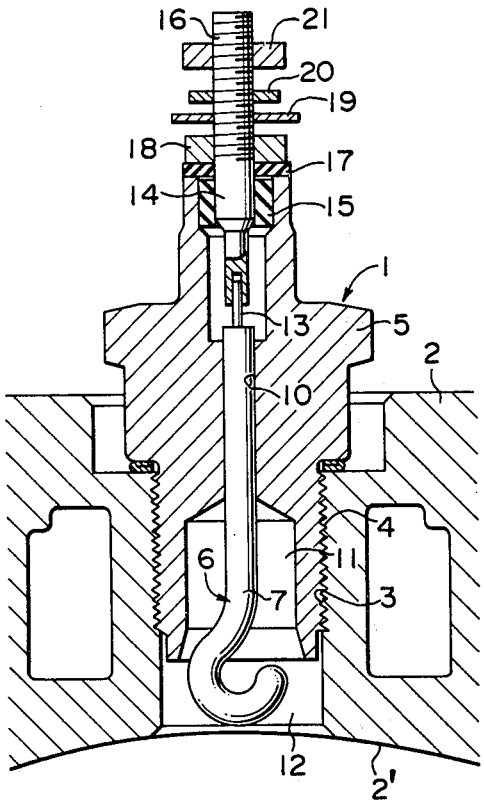
FIG. 1 is a sectional view showing an embodiment of the sheath glow plug of the present invention mounted in the housing of a rotary piston engine.
Figure 2:
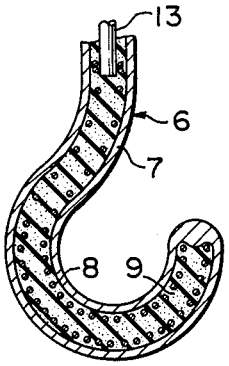
FIG. 2 is an enlarged sectional view of the heater tip portion of the sheath glow plug shown in FIG. 1.

Referring to FIG. 1, a glow plug generally designated by reference numeral 1 comprises a metal plug housing 5 having a threaded portion 4 threaded into a corresponding threaded bore 3 formed in the rotor housing 2 of a rotary piston engine. Along the central axis of the plug housing is mounted a heater element 6. The heater element is composed of a protective tube 7 made of heat-resistive metal and a heater coil 8 and insulating material 9 such as magnesia or the like mounted in the protective tube 7, as shown in FIG. 2. The root portion of the protective tube is inserted into a central bore 10 formed in the plug housing 5 and is fixed thereto by brazing or other connecting means. The tip end portion of the protective tube projects from the tip portion of the plug housing 5 in which is formed a counter-bore 11. In the embodment shown in FIGS. 1 and 2, the projected tip portion of the protective tube is formed like a hook. As shown in FIG. 1, the hooked tip portion of the protective tube is positioned in the plug hole 12 formed in the rotor housing 2 when the plug housing 5 is mounted to its normal position with its threaded portion 4 being completely threaded into the threaded bore 3.

In the embodiment shown in FIG. 2, the heater coil 8 is provided only in the hooked portion of the protective tube 7. Furthermore, in accordance with the present invention, the density of the heater coil in the tip portion of the protective tube is made higher than that in the rear or root region of the hooked portion of the protective tube or, in other words, the pitch of the heater coil is made smaller in the tip area than in the root area. At the forward end the heater coil 8 is electrically connected to the protective tube 7 which is grounded by way of the plug housing 5 and the rotor housing 2 while the rear end of the heater coil is electrically connected to a core wire 13 electrically insulated from the protective tube 7. The core wire 13 is electrically connected to a terminal stem 14 of the plug. The terminal stem 14 is supported by the plug housing 5 by way of a packing ring 15 made of heat-resistant rubber or the like and projects rearwards from the plug housing to provide a terminal element. The projected end portion of the stem 14 is formed as a threaded portion 16 supporting an insulating washer 17, a fixed nut 18, a plain washer 19 to be connected with a wire cord from an electric source (not shown), a spring washer 20 and a clamping nut 21.

In operation, an electric current is passed through the stem 14, core shaft 13, heater coil 8, protective tube 7, plug housing 5 and rotor housing 2, thereby heating to a red-hot condition hooked portion of the protective tube 7. In this heating, the tip portion of the protective tube in which the pitch of the heater coil 8 is relatively small is supplied with a larger amount of heat while the tip portion of the protective tube is subject to a higher degree of cooling by the flow of fuel-air mixture which mostly traverses the tip portion, whereby the tip portion is maintained at a designed temperature which is desirable for effecting good ignition of the fuel-air mixture. On the other hand, the rear or root portion of the protective tube 7 which is less traversed by the flow of fuel-air mixture is supplied with a less amount of heat due to a low-density arrangement of the heater coil in this region thereby also establishing a proper balance between heat generation and heat loss so as to maintain a moderate temperature in this region. Thus, a trouble such as fusing breakage of the heater coil due to overheating in this region is positively avoided.

The curved tip portion of the protective tube positioned in the plug hole 12 provides a relatively large heating surface area which ensures good ignition of the fuel-air mixture contained in the combustion chamber.

Figure 3:
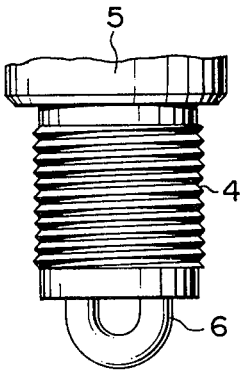
FIGS. 3 and 4 are side views showing the plug tip portion of other embodiments of the sheath glow plug of the present invention.
Figure 4:
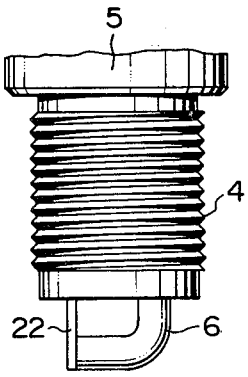

The curved tip portion of the heater element 6 or the protective tube 7 may be formed in other shapes such as "U" as shown in FIG. 3 or "L" as shown in FIG. 4. In the case of the U-shaped tip portion, the two leg portions may be supported by the plug housing 5. In the case of the L-shaped tip portion, a supporting bridge element 22 may be provided to positively support the tip end of the protective tube from the plug housing.

From the foregoing it will be appreciated that the sheath glow plug of the present invention provides a larger effective heating surface area for the fuel-air mixture contained in the combustion chamber, said effective heating surface being maintained at a sufficiently high temperature required for effecting good ignition for the fuel-air mixture while maintaining the root portion of the heater element at a moderate temperature in spite of less flow of cooling fuel-air mixture in this area thereby avoiding any trouble such as fusing breakage of the heater coil due to overheating in this area while saving consumption of electric power which has been uselessly consumed in conventional glow plugs.

Although the invention has been shown and described with reference to some preferred embodiments thereof, it is to be understood by those skilled in the art that various changes and/or omissions with regard to various parts thereof can be made therein without departing from the scope of the present invention.

We claim:

1. A sheath glow plug for rotary piston engines adapted to be mounted within an engine plug hole so as not to project from said plug hole and to be traversed by a flow of fuel-air mixture temporarily trapped in said plug hole, comprising, a plug housing adapted to be secured in said plug hole, an elongated metallic protective tube of a relatively small diameter when compared with the diameter of said plug hole and having such a length as to provide a substantially straight root portion at which it is supported to extend from said housing with said root portion lying in a plane and, at its terminating end, a hook-shaped free tip portion having a closed end spaced from said root portion and said housing, said root and tip portions both being entirely disposed within said plug hole when the glow plug is mounted therein, said hook-shaped free tip portion lying in substantially the same plane as said root portion, a helical heater coil made of a substantially uniform heating wire and mounted in said protective tube and being disposed in said root and tip portions thereof, the pitch of said heater coil being smaller at said hook-shaped free tip portion than at said root portion, and electrical terminal means mounted in said housing in electrical connection with said heater coil and adapted to connect said heater coil to a power source.

2. The plug of claim 1, wherein the end of said protective tube in said hook-shaped free tip portion is directed toward said plug housing.

* * * * *